United States Patent [19]

Nagasawa

[11] 4,014,309

[45] Mar. 29, 1977

[54] CAPACITOR DISCHARGE TYPE CONTACTLESS IGNITION SYSTEM FOR INTERNAL COMBUSTION ENGINES

[75] Inventor: Masao Nagasawa, Kariya, Japan

[73] Assignee: Nippondenso Co., Ltd., Kariya, Japan

[22] Filed: Oct. 16, 1974

[21] Appl. No.: 515,247

[30] Foreign Application Priority Data

Oct. 17, 1973 Japan ..... 48-117120

[52] U.S. Cl. ..... 123/148 CC; 123/148 S

[51] Int. Cl.[2] ..... F02P 1/00

[58] Field of Search ..... 123/148 CC, 148 S

[56] References Cited

UNITED STATES PATENTS

| | | | |
|---|---|---|---|
| 3,554,179 | 1/1971 | Burson | 123/148 MC |
| 3,566,188 | 2/1971 | Minks | 123/148 MC |
| 3,612,023 | 10/1971 | Sohner | 123/148 MC |
| 3,612,948 | 10/1971 | Minks | 123/148 MC |
| 3,715,650 | 2/1973 | Draxler | 123/148 MC |
| 3,741,185 | 6/1973 | Swift et al. | 123/148 MC |
| 3,750,637 | 8/1973 | Minks | 123/148 MC |
| 3,824,976 | 7/1974 | Katsumata | 123/148 MC |

*Primary Examiner*—Ronald B. Cox
*Attorney, Agent, or Firm*—Cushman, Darby & Cushman

[57] ABSTRACT

In the ignition system having a thyristor for performing a switching action, another thyristor is connected to capacitor charging coils in parallel with the thyristor, a primary winding of a transformer is connected in series with the another thyristor, a secondary winding is connected to a gate of the thyristor, and a trigger coil generating an ignition signal and a reversion protecting signal is connected to a gate of the another thyristor. By the transformer and the another thyristor, only the ignition signal is applied to the gate of the thyristor during a normal running of an engine, while only the reversion protecting signal is applied to the gate of the thyristor during a reverse rotation of the engine to prevent a capacitor from being charged thus protecting the reverse rotation.

23 Claims, 17 Drawing Figures

(A)

(B)

CAPACITOR DISCHARGE TYPE CONTACTLESS IGNITION SYSTEM FOR INTERNAL COMBUSTION ENGINES

BACKGROUND OF THE INVENTION

The present invention relates to an ignition system, especially to a contactless capacitor discharge type ignition system for an internal combustion engine, in which a magneto generator is employed as an electric power source for charging a capacitor provided therein, and more especially to an ignition system which prevents particularly a two-cycle engine from being continued to rotate in a reverse direction.

In a conventional ignition system of this kind, it is known that continuation of reverse rotation of an engine is prevented by preventing the system from supplying an ignition signal to a control gate of a switching element such as a thyristor; however when the engine is forced to rotate in the reverse direction at a high speed due to some accidental reasons the capacitor is charged by higher voltage produced at the magneto generator, and thereby such electric elements as the capacitor, thyristor, a diode or the like may be broken because of such high voltage.

SUMMARY OF THE INVENTION

It is, therefore, a primary object of the present invention to overcome the drawbacks mentioned above, and for this purpose when the engine is rotated in the reverse direction by accident the voltage produced at the magneto generator is bypassed so as not to charge the capacitor.

Another object of the present invention is to provide an ignition system in which during a reverse rotation of an engine an ignition spark may be carried out at an instant other than an appropriate ignition time, for example at the instant where a piston of the engine is positioned at a bottom dead center, whereby the continuation of the reverse rotation can be prevented and further a capacitor or the like is prevented from overcharge.

A further object of the present invention is to provide an ignition system which can prevent the engine from continuing to rotate in the reverse direction.

A further object of the present invention is to provide an ignition system, in which the capacitor is charged with more than two half-waves of an alternating current produced at the magneto generator, thereby to obtain higher ignition energy at a spark plug.

These together with other objects and advantages which will become subsequently apparent reside in the details of construction and operation as more fully herinafter described and claimed, reference being had to the accompanying drawings forming a part thereof.

DESCRIPTION OF THE PREFERRED EMBODIMENTS

Figure 1:
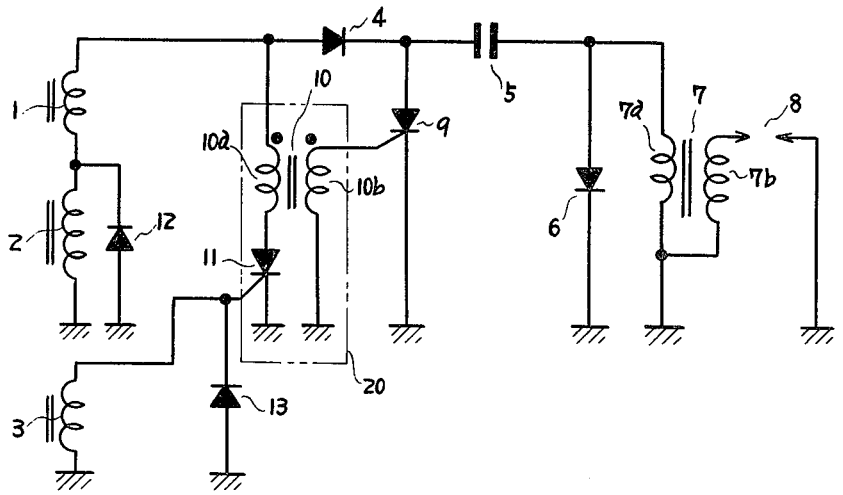
FIGS. 1, 4, 5, 6, 8, 9, 10, 11, 12, 13, 14, 15 and 16 are respectively a first to thirteenth embodiment of the present invention.

In the FIG. 1 embodiment of the present invention, capacitor charging coils 1 and 2 are mounted in a magneto generator (whose construction is described hereinafter in detail) fixed to an internal combustion engine for producing alternating current in synchronism with the rotation thereof. The number of turns of the coil 1 is lower than that of the coil 2. A trigger coil 3 generates an ignition signal as well as a reversion protecting signal. A diode 4 for rectifying the alternating current produced at the capacitor charging coils 1 and 2, a capacitor 5 for charging the rectified current and a primary winding 7*a* of an ignition coil 7 are connected in series. The ignition coil 7 has a secondary winding 7*b* connected to a spark plug 8. A diode 6 is connected in parallel with the primary winding 7*a* for extending an arc duration of an ignition spark at the spark plug 8. A thyristor 9 has a control gate connected to a thyristor control means 20. The thyristor control means 20 includes a transformer 10 whose primary winding 10*a* is connected in parallel with the coils 1 and 2, and whose secondary winding 10*b* is connected to the control gate of the thyristor 9, and another thyristor 11 connected in series with the primary winding 10*a*. A control gate of the other thyristor 11 is connected to the trigger coil 3 in parallel with a diode 13.

A construction of a magneto generator, which may be employed in the present invention, of an outer revolving six-pole type will be described with references in FIGS. 3(A) and 3(B), in which a rotor 30 comprises an iron shell 31, six permanent magnets 32*a* to 32*f* spaced at equal intervals and securely embedded in the inner side of the iron shell 31 by means of a nonmagnetic material 31*a* such as aluminum or resin, six pole pieces 33*a* to 33*f* secured respectively to the inner face of the permanent magnets 32*a* to 32*f*, a center piece 34 securely mounted on a crankshaft 34*a* of the engine by a nut 34*b* and securely fixing the iron shell 31 by means of rivets which are not shown, and timing cores 35*a* to 35*d* secured to the center piece 34.

A stator 40 is secured to the engine, on which capacitor charging cores 41 and 42 are placed one upon another. The capacitor charging coils 1 and 2 are wound respectively on the cores 41 and 42. A lamp load core 43 is securely mounted on the stator 40 at a position displaced by about 180°, i.e., opposite to the capacitor charging cores 41 and 42, with a lamp load power supply coil 44 constituting a power supply for a load such as lamps.

A stator 22 of a timing signal generator is securely mounted on the stator 40 at a position displaced by about 90 degrees from the capacitor charging cores 41 and 42, and comprises, a permanent magnet 46, cores 47*a* and 47*b* disposed on the opposite sides of the magnet 46, the trigger coil 3 wound on both cores 47*a* and 47*b*, a case 49 in which these elements are housed and a sealing resin 45 filed in the case 49.

Figure 2:
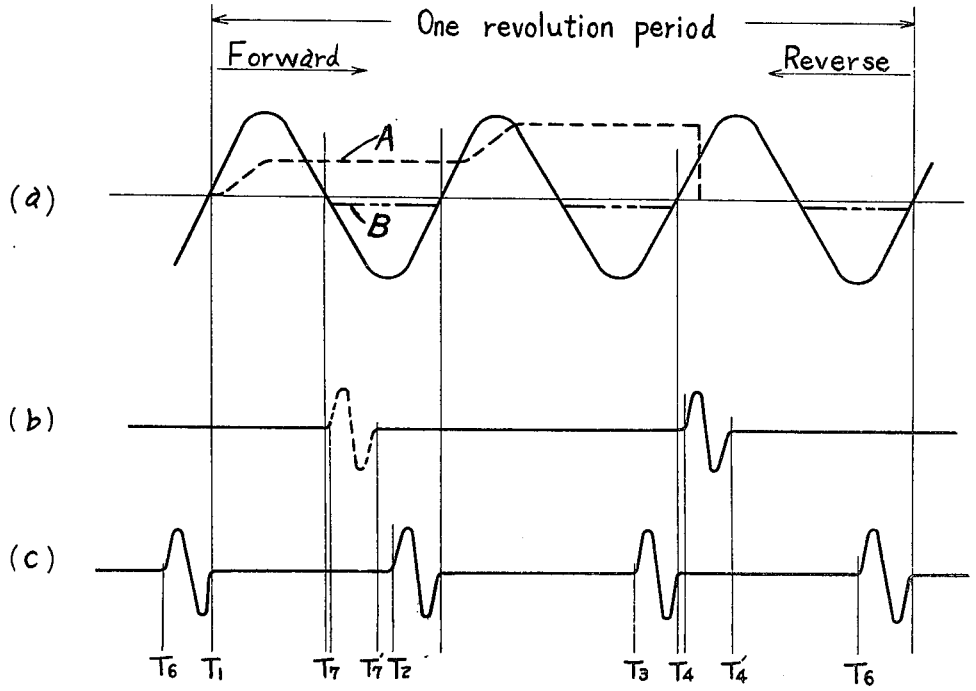
FIGS. 2 and 7 are waveform diagrams showing operation of the above respective embodiments.

With the magneto generator constructed as above described, for each revolution of the magneto generator, i.e., for each rotation of the engine crankshaft 34*a*, the capacitor charging coils 1 and 2 together generate three cycles of the AC no-load voltage as shown in FIG. 2(*a*), while for each rotation of the crankshaft 34*a*, the timing generator, namely the trigger coil 3, generates an ignition signal as shown in FIG. 2(*b*) by a solid line as well as the reversion protecting signals as shown in FIG. 2(*c*). The ignition signal is generated when the output voltage of the coils 1 and 2 is positive and the reversion protecting signals are generated just before the output voltage of the coils 1 and 2 changes from the negative to the positive direction.

The operation of the embodiment constructed as described above will now be explained. The operation of the various parts of the embodiment which take place along with the rotation of the engine will be explained. The capacitor 5 is going to be charged from a time T1 with the positive half waves produced at the capacitor charging coils 1 and 2 as indicated by a dash line A in FIG. 2(*a*). Here, when the engine rotates at a low speed, the capacitor charging coil 2 having a relative large number of winding turns mainly serves to charge the capacitor 5, while the coil 1 mainly serves to charge the capacitor 5 at a high speed of the engine through the diode 12, which also clips the negative half waves developed by coils 1 and 2, as shown by the double dash broken line B in FIG. 2*a*. At time T4 when the trigger coil 3 generates an ignition signal, the other thyristor 11 is driven into conduction due to the positive electric potential at the anode of the thyristor 11 and the positive half cycle of the T4 ignition signal, the negative half cycle of which is grounded by diode 13. The transformer 10 then generates an output voltage to supply it to the gate of the thyristor 9, and the thyristor 9 is made conductive, whereby the charge stored in the capacitor 5 is discharged through the thyristor 9 to ground and upward through the primary winding 7*a* of the ignition coil 7 to induce a high voltage at the secondary winding 7*b*, thus producing an ignition spark at the spark plug 8. The trigger coil 3, of course, generates the reversion protecting signals at times T2, T3 and T6 as shown in FIG. 2(*c*), however the thyristor 11 can not be made conductive due to the negative electrical potential at the anode thereof at those times, whereby the thyristor 9 is not effected. Accordingly the capacitor 5 is charged with a plurality of positive half waves from the time T1 to T4 as shown by dash line A in FIG. 2(*a*) without any influences of the reversion protecting signals. Repeating the above described operation, the ignition spark is produced for each revolution of the magneto generator.

On the other hand, when the engine is forced to rotate in the reverse direction by accident, the polarity of the generated voltages of the capacitor charging coils 1 and 2 and the trigger coil 3 is changed to the opposite i.e., that for reverse rotation the positive and negative half cycles for each signal are inerchanged in position. The operation in the reverse rotation of the engine will be described with reference to FIG. 2. The reversion protecting signals at the trigger coil 3 are generated during reverse operation just after the start of every positive half wave that is generated at the capacitor charging coils 1 and 2, contrary to the normal situation which occurs during forward running of the engine. Because of the positive half wave at the capacitor charging coils 1 and 2 when the reversion protecting signals are generated at the trigger coil 3, the other thyristor 11 is made conductive as soon as every positive half-wave is generated. Accordingly the thyristor 9 is made conductive because of the output at the secondary winding 10*b* of the transformer 10, whereby every positive half wave at the capacitor charging coils 1 and 2 is grounded through the thyristor 9, thus preventing the capacitor 5 from being charged. Consequently the ignition spark is not produced and the reverse rotation of the engine is prevented from being continued.

The ignition signal at the time T4′ has no influence on the thyristor 9 during the reverse rotation of the engine, since the electric potential at the anode thereof is negative at the time T4′ when the ignition signal is generated.

Generally speaking, as a thyristor having a large capacity operates with low sensitivity corresponding to the amount of the capacity, a trigger coil for controlling such a thyristor must be designed larger in order to perform well during the low speed of the engine. However, according to the present invention, the trigger coil 3 is connected to the thyristor 9 having the large capacity through the transformer 10 to which the other thyristor having a relatively small capacity is connected, whereby the trigger coil 3 need not to be designed larger in order to operate the other thyristor 11 with high sensitivity and further the thyristor 9 operates well because of a signal, at its control gate, amplified by the transformer 10.

In the above explained embodiment, the capacitor is prevented from being charged during the reverse rotation of the engine in order to prevent the reverse rotation, however another modification for protecting the reverse rotation wil be described with references in FIGS. 1 and 2. According to the modification, the reversion protecting signals generated at the times T2, T3 and T6 are not necessary, however instead of those the trigger coil 3 is so designed to generate a reverse ignition signal at a time T7 as indicated by a broken line in FIG. 2(*b*) as well as the ignition signal at the time T4. The reverse ignition signal has no influence on the operation of this ignition system during the normal running of the engine, because the other thyristor 11 can not be made conductive due to the negative electrical potential at the anode thereof at the time T7. However when the engine is forced to rotate in the reverse direction by accident causing the reverse signal generated by coils 1 and 2 to be positive while the T7′ – T7 reverse ignition signal appears, the reverse ignition signal makes the thyristor 9 conductive, thereby to produce an ignition spark at the time T7′for the ignition signal at the time T4′ has no influence on the thyristor 9 during the reverse rotation of the engine as explained in the above embodiment. The time T7′ approximately corresponds to a bottom dead center of the engine, and therefore the engine can not obtain enough power to continue to rotate in the reverse direction.

Figure 3:
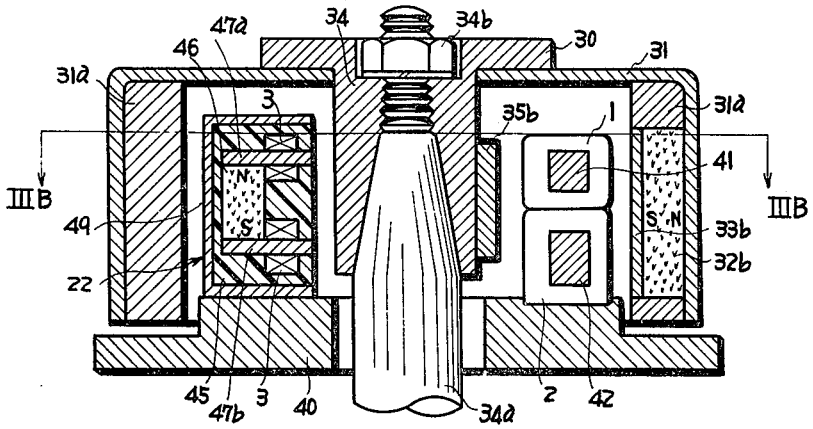
FIGS. 3(A) and 3(B) are respectively a longitudinal sectional view of a magneto generator employed in the present invention, being taken along the line IIIA—IIIA in FIG. 3(B), and a transverse sectional view taken along the line IIIB—IIIB in FIG. 3(A).
Figure 3:
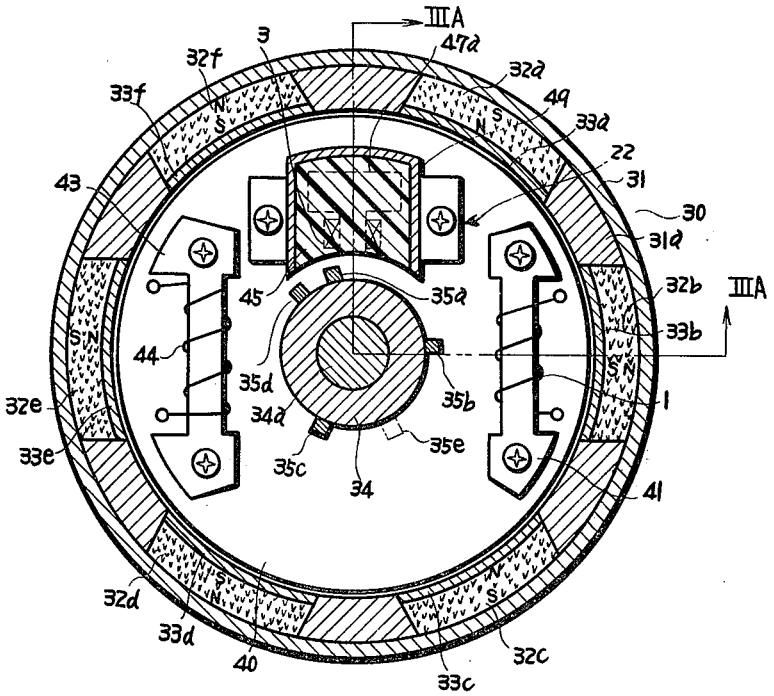

The construction of the magneto generator for this modification is completed by taking away the timing cores 35*b*, 35*c* and 35*d* and providing a core 35*e* on the center piece 34 in FIG. 3 so as to obtain the reverse ignition signal.

Figure 4:
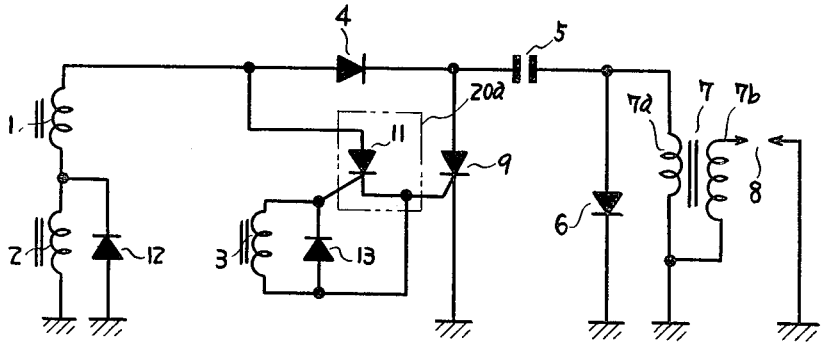

FIG. 4 shows another embodiment of the present invention, in which the thyristor control means 20 in FIG. 1 is replaced with a thyristor control means 20*a* in this embodiment by eliminating the transformer 10, and the operation of this embodiment is almost the same as that of the first embodiment, whereby it is omitted.

Figure 5:
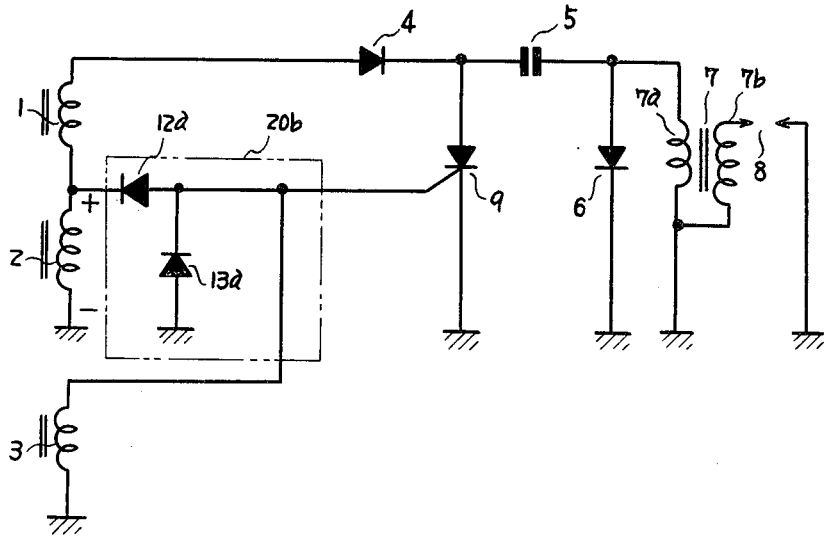

FIG. 5 shows still another embodiment, in which thyristor control means 20*b* included diodes 12*a* and 13*a*, the cathode of the diode 12*a* being connected to a junction point of the capacitor charing coils 1 and 2.

The operation of this FIG. 5 embodiment will be described with reference to FIG. 2. When the ignition signal is generated at the trigger coil 3 at the time T4 during the normal running of the engine, the polarity of the output voltage at the coil 2 is so designated in FIG. 5, that is, the electric potential at the junction point is positive but negative at the grounded terminal of the coil 2. Therefore the positive half wave of the ignition signal generated at the trigger coil 3 cannot go forward through diode 12*a*, so hence it is supplied to the gate of the thyristor 9 to make it conductive to produce the ignition spark.

In FIG. 5, when the reversion protecting signals are generated at the trigger coil 3 at the times T2, T3 and T6 in FIG. 2 during the normal running of the engine, the polarity of the generated voltage at the capacitor charging coil 2 is reversed, that is the potential at the junction point is negative and the potential at the grounded terminal of the coil is positive. Therefore the positive half waves of the reversion protecting signals are not supplied to the gate of the thyristor 9 but bypassed to the ground through the diode 12*a* and the coil 2. Accordingly the positive half waves produced at the capacitor charging coils 1 and 2 operate similarly as in FIG. 1 to charge capacitor 5 as shown by dash line A in FIG. 2.

However when these reversion protecting signals are generated during the reverse rotation of the engine, the potential at the junction point of the capacitor charging coils 1 and 2 is positive and the potential at the grounded terminal thereof is negative. Therefore these signals are applied to the gate of the thyristor 9 to make it conductive, whereby the positive half-waves produced at the capacitor charging coils 1 and 2 are always bypassed to the ground through the thyristor 9 not to charge the capacitor 5, thus preventing the engine from firing and further preventing break down of the capacitor or the like from high voltage.

Figure 6:
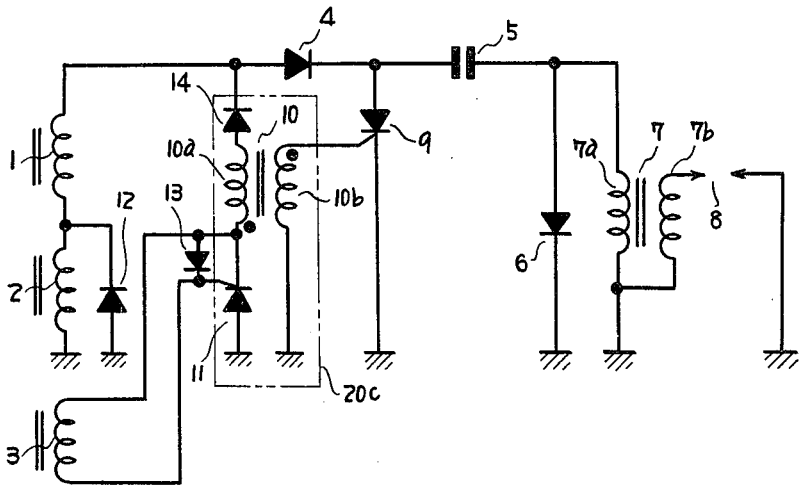

FIG. 6 shows a further embodiment of the present invention, in which a transformer 10 consists of differential windings 10*a* and 10*b*, and other parts are almost the same as that in FIG. 1.

Figure 7:
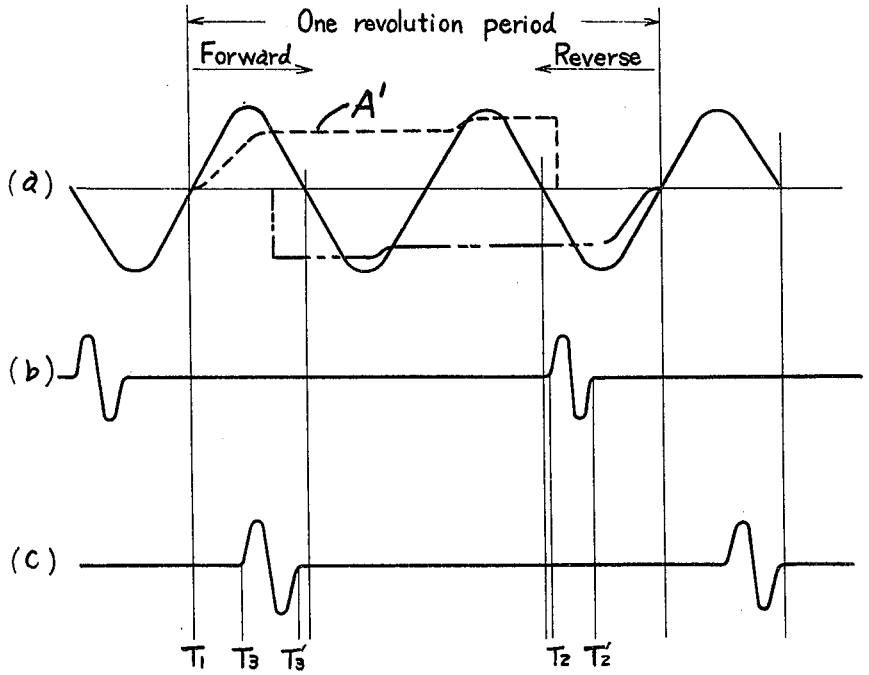

The operation of the fourth embodiment will be described with references in FIG. 7, employing a four pole magneto generator. When the output voltage of the capacitor charging coils 1 and 2 begins to increase in the positive direction at a time T1 in FIG. 7(*a*), in which the output voltage is indicated by a solid line, electric current flows through the capacitor charging coils 2 and 1, the diode 4, the capacitor 5, the parallel circuit of the diode 6 and the primary winding 7*a* of the ignition coil 7 and the ground in order to charge the capacitor 5 as indicated by a dotted line A′ in FIG. 7(*a*). The capacitor 5 is charged by the current having the two positive half-waves. When the output voltage of the capacitor charging coils 1 and 2 begins to increase in the negative direction at a time T2, a timing signal is generated at the trigger coil 3 as shown in FIG. 7(*b*) to make the thyristor 11 conductive. Though at a time T3 earlier than the time T2 a reversion protecting signal is generated at the trigger coil 3 as shown in FIG. 7(*c*), the thyristor 11 can not be made conductive since at that time the negative potential is applied to the anode of the thyristor 11. On the contrary since at the time T2 the positive potential is applied to the anode of the thyristor 11 and the negative potential is applied to the cathode thereof, the thyristor 11 is made conductive, whereby electric current flows through the capacitor charging coils 1 and 2, the ground, the thyristor 11, the primary winding 10*a* of the transformer 10 and the diode, thus producing an ignition signal at the secondary winding 10*b* of the transformer 10. Then the thyristor 9 is made conductive due to the ignition signal as its gate, the charge stored in the capacitor 5 is discharged through the thyristor 9, the ground and the primary winding 7*a* of the ignition coil 7 to induce a high voltage at the secondary winding 7*b* of the ignition coil 7, thereby to produce an ignition spark at the spark plug 8.

If the engine is forced to rotate in the reverse direction by accident, the polarity of the output voltage of the capacitor charging coils 1 and 2 is reversed. Hence, when the ignition signal is generated at the trigger coil 3 at a time T2′ the thyristor 11 is not made conductive since the negative potential is applied to the anode thereof and the ignition timing signal of FIG. 2(*b*) is ignored. On the contrary when the reversion protection signal occurs at a time T3′ the thyristor 11 is made conductive since the positive potential is applied to the anode thereof. Then an ignition spark is produced at the spark plug 8 at the time T3′, however the time T3′ is approximately equivalent to a bottom dead center judging from the position of the piston corresponding to that time. Therefore the reverse rotation of the engine can not be continued.

Figure 8:
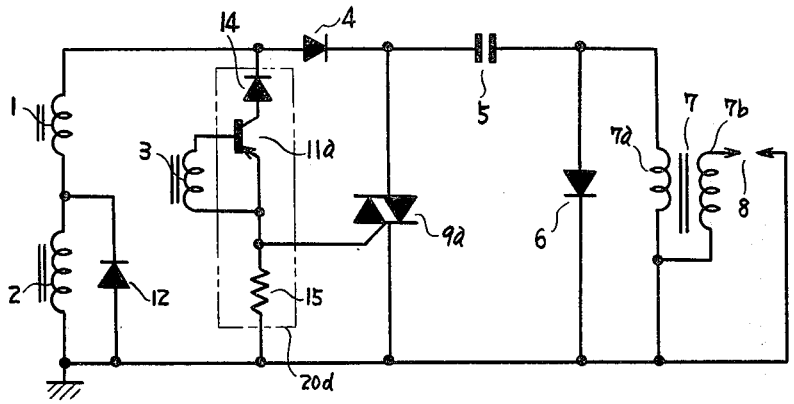

FIG. 8 shows another embodiment of the present invention, in which a bidirectional thyristor 9*a* is employed instead of the thyristor 9 in comparison with the embodiment shown in FIG. 6, and further a thyristor control means 20*d* consists of a transistor 11*a*, a resistor 15 and a diode 14 instead of the transformer 10 in FIG. 6. The other construction is almost same as that shown in FIG. 6.

The operation of this embodiment will be described with references in FIG. 7. The trigger coil 3 generates the reversion protecting signal at the time T3 as well as the ignition signal at the time T2. Thyristor control means 20*d* generates a signal to supply it to the gate of the thyristor 9*a* only when the negative half-wave is generated at the coils 1 and 2 and the trigger coil 3 generates either the ignition signal or the reversion protecting signal. Accordingly the thyristor 9*a* is supplied with the signal at its gate only at the time T2 to produce the ignition spark during the normal running of the engine, and further supplied with the signal only at the time T3′ during the reverse rotation. Then the reverse rotation of the engine will be prevented from being continued in the same manner described in the embodiment in FIG. 6.

Figure 9:
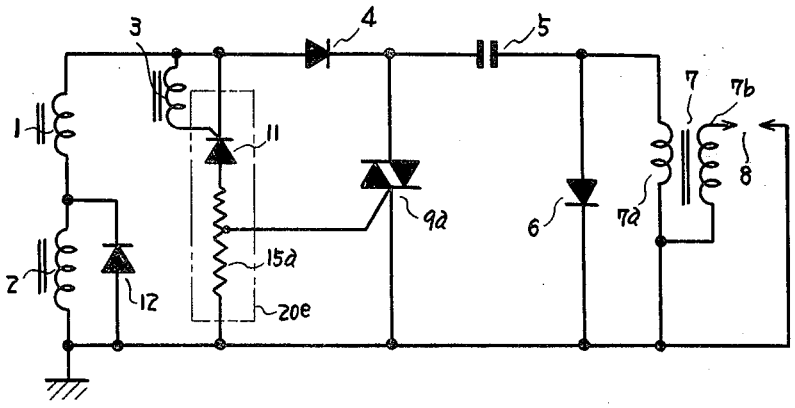

FIG. 9 shows a further embodiment of the present invention, in which the thyristor control means 20*e* consists of an auxiliary thyristor 11 and a voltage dividing resistor 15*a* replacing each element in the thyristor control means 20*d* in FIG. 8. The operation of this embodiment is almost the same as that described in FIG. 8, and therefore the operation is not repeated here.

Figure 10:
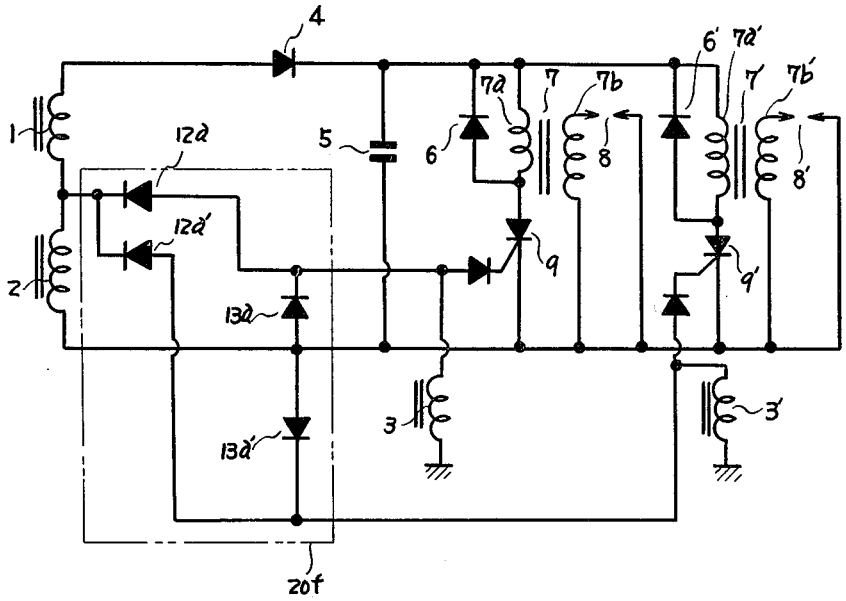

FIG. 10 shows an embodiment of the present invention, which is designed for a two cylinder engine with a four-pole magneto generator by modifying the embodiment shown in FIG. 5. Numeral 3′ designates a trigger coil, 6′, 12*a*′ and 13*a*′ diodes, 7′ an ignition coil having a primary winding 7*a*′ and a secondary winding 7*b*′, 8′ a spark plug and 9′ a thyristor. A thyristor control means 20*f* included diodes 12*a*, 12*a*′, 13*a* and 13*a*′. When the trigger coils 3 and 3′ produce alternatively timing signals having an interval of 180°, the thyristors 9 and 9′ are alternatively driven into conduction in accordance with the timing signals at the trigger coils 3 and 3'.

Figure 11:
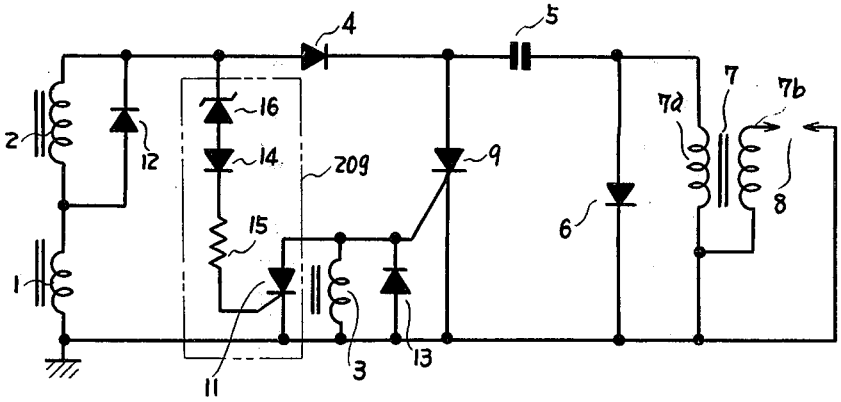

FIG. 11 shows another embodiment of the present invention. A thyristor control means 20g includes diode 14, a resistor 15, a zener diode 16 and an auxiliary thyristor 11, and the trigger coil 3 is connected to the anode of the auxiliary thyristor 11 as well as the gate of the thyristor 9.

The operation of the FIG. 11 embodiment will be described with reference to FIG. 7. The trigger coil 3 generates the ignition signal at the time T2 as well as the reversion protecting signal at the time thyristor 11 will not conduct when the FIG. 7(a) voltage on its gate is negative, so only the ignition signal is supplied to the gate of the thyristor 9 during the normal running of the engine, the reversion protecting signal being bypassed through the auxiliary thyristor 11 because of conduction thereof at the time T3.

Contrary to that, only the reversion protecting signal is supplied to the gate of the thyristor 9 during the reverse rotation of the engine, whereby the reverse rotation of the engine can be prevented from being continued as in the same manner described above.

Figure 12:
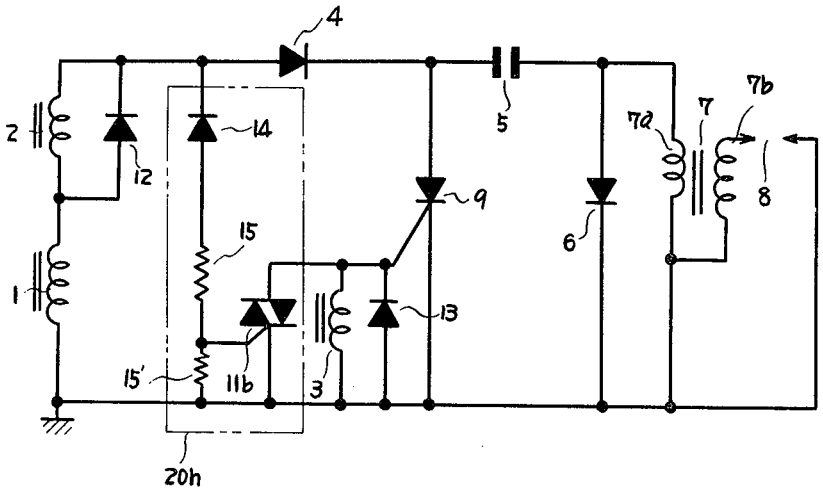

FIG. 12 shows a still further embodiment of the present invention. Difference with regard to FIG. 11 resides in that the thyristor control means 20h includes a bidirectional thyristor 11b, resistors 15 and 15' and a diode 14.

The operation of the embodiment shown in FIG. 12 will be described with reference to FIG. 2. The trigger coil 3 generates the reversion protecting signal at the time T7 as well as the ignition signal at the time T4. Since the bidirectional thyristor 11b is made conductive when the negative half-wave is generated at the coils 1 and 2, for example at the time T7, the reversion protecting signal produced at the trigger coil 3 is bypassed through the bidirectional thyristor 11b. Accordingly the capacitor 5 is charged with two positive half-waves as shown by dash line A in FIG. 2(a), and the charge stored in the capacitor 5 is discharged at the time T4 to produce the ignition spark. When the engine is forced to rotate in the reverse direction the polarity of the output voltage at the coils 1 and 2 is reversed, whereby only the reversion protecting signal is supplied to the thyristor 9 to produce the ignition spark at instant where the piston is positioned around the bottom dead center, thus preventing the reverse rotation of the engine and further electric components from high voltage.

Figure 13:
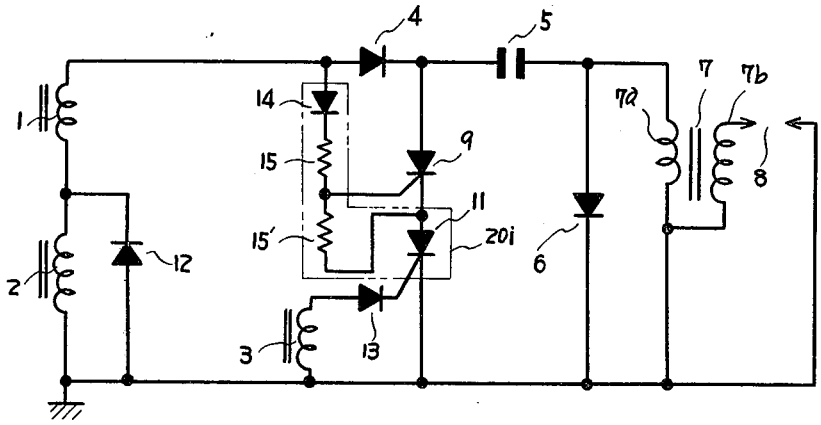

FIG. 13 shows a further embodiment of the present invention, in which the difference with regard to the embodiment shown in FIG. 12 resides in that the thyristor control means 20i includes a diode 14, resistors 15 and 15' and another thyristor 11. The other construction and the operation are substantially the same as that of FIG. 12.

Figure 14:
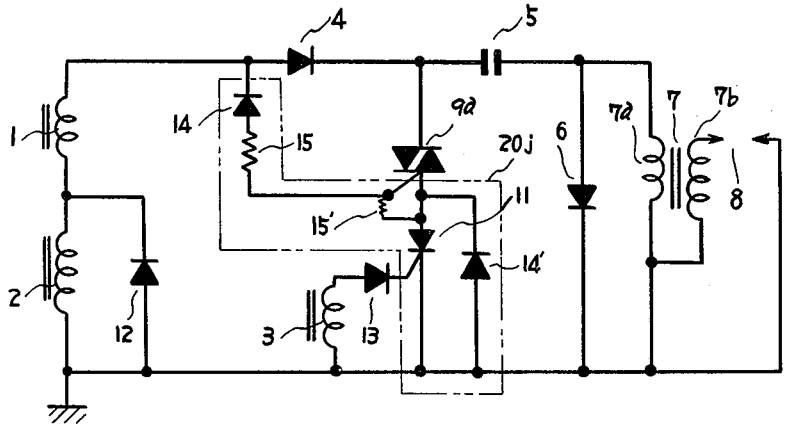

FIG. 14 shows an embodiment of the present invention in which the thyristor 9 is replaced by the bidirectional thyristor 9a and the thyristor control means 20j is provided between the bidirectional thyristor 9a and the trigger coil 3. The thyristor control means 20j includes diodes 14 and 14', the resistors 15 and 15' connected in series with each other and another thyristor 11 connected in parallel with the diode 14'. The other construction and the operation are substantially the same as that of FIG. 6.

Figure 15:
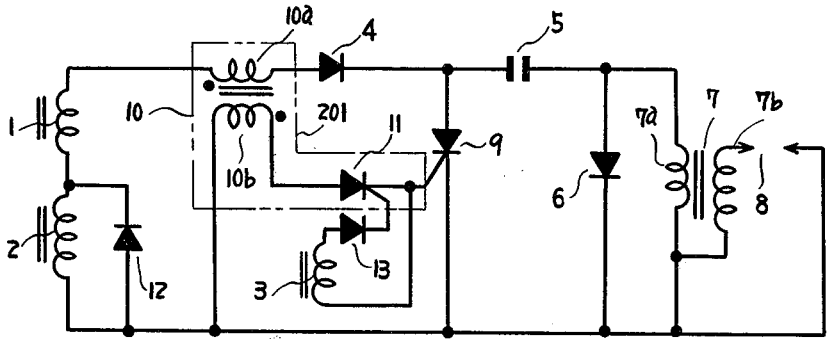

FIG. 15 shows a further embodiment of the present invention, in which the difference with regard to the embodiment shown in FIG. 4 resides in the thyristor control means 201 in that a transformer 10 is so provided that the primary winding 10a thereof is connected in series with the capacitor charging coils 1 and 2 and the secondary winding 10b is connected in series with the other thyristor 11. The operation of this embodiment is substantially the same as that of the second embodiment shown in FIG. 4.

Figure 16:
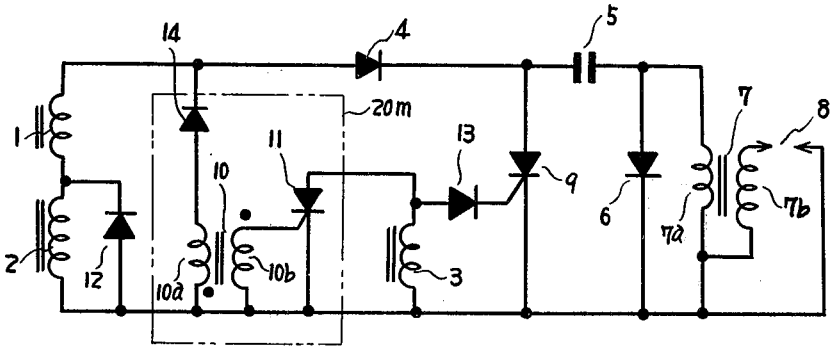

FIG. 16 shows a still further embodiment of the present invention, in which the difference with regard to FIG. 12 resides in the thyristor control means 20m which includes diode 14, a primary winding 10a of a transformer 10 connected in series with each other, and another thyristor 11 connected to the secondary winding 10b of the transformer 10. The operation is substantially the same as that of FIG. 12.

What we claim is:

1. A capacitor discharge type contactless ignition system for an internal combustion engine comprising:

a magneto generator including a stator, a rotor rotated in synchronism with rotation of an engine, a plurality of magnets mounted on and symmetrically disposed about said rotor for rotation therewith, a trigger magnet mounted on said stator, and a trigger core and at least one reversion core disposed adjacent said trigger magnet and rotated in synchronism with the rotation of the engine;

capacitor charging coil means mounted on said stator adjacent said rotor for generating alternating current having a first polarity half wave and a second polarity half wave in synchronism with the rotation of an engine in response to passage of said plurality of magnets past said capacitor charging coil means, one of said polarities being positive and the other polarity being negative during rotation produced by normal running of said engine and said one polarity being negative and said other polarity positive during reverse rotation of said engine;

capacitor means connected in series with said capacitor charging coil means for storing said first half waves of said alternating current;

switching means having a control gate and connected to said capacitor means;

an ignition coil having a primary winding connected in series with said capacitor means and said switching means and a secondary winding;

a spark plug connected to said secondary winding;

trigger coil means mounted on said stator adjacent said trigger magnet for generating reversion protecting signals and ignition signals in response to passage of said trigger and reversion cores past said trigger magnet; and thyristor control means connected to said gate of said switching means, to said capacitor charging coil means and to said trigger coil means for rendering said switching means conductive to complete a discharge path through said ignition coil for discharging said capacitor means in response to said ignition signals and said first half waves during a normal running of said engine and for responding to said reversion protecting signals and said seco..d half waves to cause said switching means to become conductive during a reverse rotation of said engine in order to prevent said reverse rotation.

2. A capacitor discharge type contactless ignition system as claimed in claim 1, wherein said thyristor control means comprises;

a transformer having a primary winding and a secondary winding connected to the gate of said switching means; and a thyristor having a control gate connected to said trigger coil means, an anode thereof being connected to said primary winding of said transformer.

3. A capacitor discharge type contactless ignition system as claimed in claim 1, wherein said thyristor control means comprises;

a thyristor having a control gate connected to said trigger coil means and connected to the gate of said switching means at its cathode.

4. A capacitor discharge type contactless ignition system as claimed in claim 1, wherein said thyristor control means comprises;

a diode connected to said capacitor charging coil means at its cathode and to said trigger coil means at its anode.

5. A capacitor discharge type contactless ignition system as claimed in claim 1, wherein said thyristor control means comprises;

a transistor connected across said capacitor charging coil means, a base thereof being connected to said trigger coil means and an emitter thereof being connected to the gate of said switching means.

6. A capacitor discharge type contactless ignition system as claimed in claim 1, wherein said thyristor control means comprises;

a thyristor having a control gate and connnected to said trigger coil means, an anode thereof being connected to the gate of said switching means.

7. A capacitor discharge type contactless ignition system as claimed in claim 1, wherein said thyristor control means comprises;

a thyristor having a control gate and connected to the gate of said switching means at its anode; and a zener diode connected to said capacitor charging coil means at one end and to the gate of said thyristor at the other end.

8. A capacitor dishcarge type contactless ignition system as claimed in claim 1, wherein said thyristor control means comprises;

a bidirectional thyristor having a control gate and connected to said trigger coil means; and a diode connected to said capacitor charging coil means at its cathode and to said control gate at its anode.

9. A capacitor discharge type contactless ignition system as claimed in claim 1, wherein said thyristor control means comprises;

a thyristor having a control gate connected to said trigger coil means and connected to said switching means at its anode; and a series circuit of a diode and resistor, an anode of said diode being connected to said capacitor charging coil means and a cathode thereof being connected to the gate of said switching means as well as to the anode of said thyristor through said resistor.

10. A capacitor discharge type contactless ignition system as claimed in claim 1, wherein said thyristor control means comprises;

a thyristor having a control gate connected to said trigger coil means and connected to said switching means at its anode; and a series circuit of a diode and a resistor connected across said capacitor charging coil means, a cathode thereof being connected to said capacitor charging coil means and an anode thereof being connected to the gate of said switching means through said resistor.

11. A capacitor discharge type contactless ignition system as claimed in claim 1, wherein said thyristor control means comprises;

a thyristor having a control gate connected to said trigger coil means and connected to the gate of said switching means at its cathode; and a transformer having a primary winding connected in series with said capacitor charging coil means and a secondary winding connected to an anode of said thyristor.

12. A capacitor discharge type contactless ignition system as claimed in claim 1, wherein said thyristor control means comprises;

a thyristor having a control gate and connected to said trigger coil means at its anode; and a transformer having a primary winding connected in parallel with said capacitor charging coil means and a secondary winding connected to the control gate of said thyristor.

13. A system as in claim 1 wherein said reversion core is positioned to produce a reversion protecting signal during reverse rotation at a time where the engine is at its bottom dead center position.

14. A system as in claim 1 including a plurality of reversion cores symmetrically disposed about said rotor for causing said capacitor means to discharge prior to the transition of said alternating current from negative to positive during reverse rotation.

15. A capacitor discharge type contactless ignition system for an internal combustion engine comprising;

a capacitor charging coil connected to a magneto generator driven by an internal combustion engine for generating alternating current in synchronism with the rotation of said internal combustion engine, said alternating current having positive half waves and negative half waves;

a capacitor connected in series with said capacitor charging coil for storing said positive half waves;

an ignition coil having a primary winding and a secondary winding, said primary winding being connected in series with said capacitor;

a spark plug connected to said secondary winding and mounted in said internal combustion engine;

a switching means having a control gate and connected to said capacitor, said switching means, said capacitor and said primary winding forming a capacitor discharging circuit;

a trigger coil for generating first and second signals in synchronism with said internal combustion engine; and a control circuit connected to said trigger coil, said control gate of said switching means and said capacitor charging coil, said control circuit generating ignition signals in response to said first signals and the positive half waves of the alternating current produced when said internal combustion engine is rotated in a proper direction, said control circuit also generating reversion protecting signals in response to said second signals and the positive half waves of the alternating current produced when said internal combustion engine is rotated in an improper direction, said ignition signals being supplied to said control gate of said switching means to make it conductive, to thereby discharge the stored charge on said capacitor to produce on ignition spark at said spark plug when said internal combustion engine is rotated in said proper direction, said reversion protecting signals being supplied to said control gate of said switching means when said internal combustion engine is rotated in said improper direction in order to bypass said alternating current.

16. A capacitor discharge type contactless ignition system as set forth in claim 15, wherein said control circuit comprises;

a transformer having a primary coil and a secondary coil connected to the control gate of said switching means; and a thyristor having a control gate connected to said trigger coil, the anode-cathode path of said thyristor and said primary coil being connected in parallel with said capacitor charging coil.

17. A capacitor discharge type contactless ignition system as set forth in claim 15, wherein said control circuit comprises;

a thyristor having a control gate connected to said trigger coil, the anode-cathode path of said thyristor being connected between said capacitor charging coil and said control gate of said switching means.

18. A capacitor discharge type contacless ignition system as set forth in claim 15, wherein said control circuit comprises;

a diode means connected to said capacitor charging coil at its cathode, the anode thereof being connected to said trigger coil and said control gate of said switching means.

19. A capacitor discharge type contactless ignition system as set forth in claim 15, wherein said control circuit comprises;

a series circuit of a diode and a resistor so connected across said capacitor charging coil as to let the negative half waves flow therethrough; and a bidirectional thyristor having a control gate connected to said series circuit, and connected to said trigger coil and the control gate of said switching means.

20. A capacitor discharge type contactless ignition system as set forth in claim 15, wherein said control circuit comprises;

a series circuit of a diode, a resistor and an anode-cathode path of a thyristor connected across said capacitor charging coil, said control gate of said switching means being connected to said series circuit, the control gate of said thyristor being connected to said trigger coil, and said anode-cathode path of said thyristor being connected in series with said switching means.

21. A capacitor discharge type contactless ignition system as set forth in claim 15, wherein said control circuit comprises;

a transformer having a primary coil and a secondary coil, said primary coil being connected in series with said capacitor charging circuit; and a thyristor having a control gate connected to said trigger coil, the anode-cathode path thereof being connected between said secondary coil and said control gate of said switching means.

22. A capacitor discharge type contactless ignition system as set forth in claim 15, wherein said control circuit comprises;

a transformer having a primary coil and a secondary coil;

a diode connected across said capacitor charging coil through said primary coil; and a thyristor having a control gate connected to said secondary coil, the anode thereof being connected to said trigger coil and the control gate of said switching means.

23. A capacitor discharge type contactless ignition system for an internal combustion engine comprising;

means for generating alternating current in synchronism with a rotation of an internal combustion engine, said alternating current having positive and negative half waves;

means for storing said positive half waves;

means for generating first and second signals in synchronism with the rotation of said internal combustion engine;

means for generating ignition signals in response to said alternating current and said first signals when said internal combustion engine is rotated in a proper direction, and for generating reversion protecting signals in response to said alternating current and said second signals when said internal combustion engine is rotated in an improper direction;

means for discharging the stored charge of said positive half waves in response to said ignition signals when said internal combustion engine is rotated in said proper direction and for bypassing said alternating current in response to said reversion protecting signals when said internal combustion engine is rotated in said improper direction; and means for producing ignition sparks when said stored charges of said positive half waves are discharged, to thereby cause the rotation of said internal combustion engine to proceed in said proper direction.

* * * * *